US009367008B2

(12) United States Patent
Sakakibara et al.

(10) Patent No.: US 9,367,008 B2
(45) Date of Patent: Jun. 14, 2016

(54) ELECTROPHOTOGRAPHIC MEMBER AND HEAT FIXING ASSEMBLY

(71) Applicant: CANON KABUSHIKI KAISHA, Tokyo (JP)

(72) Inventors: Hiroyuki Sakakibara, Yokohama (JP); Katsuhisa Matsunaka, Inagi (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 59 days.

(21) Appl. No.: 14/287,831

(22) Filed: May 27, 2014

(65) Prior Publication Data

US 2014/0356040 A1 Dec. 4, 2014

(30) Foreign Application Priority Data

May 31, 2013 (JP) ..... 2013-115326

(51) Int. Cl.
*G03G 15/06* (2006.01)
*G03G 15/20* (2006.01)

(52) U.S. Cl.
CPC ..... *G03G 15/2057* (2013.01); *G03G 15/206* (2013.01); *G03G 2215/2035* (2013.01); *Y10T 428/249921* (2015.04); *Y10T 428/249972* (2015.04)

(58) Field of Classification Search
CPC ..... G03G 15/2057; G03G 15/206; G03G 2215/2035; Y10T 428/249921; Y10T 428/249972
See application file for complete search history.

(56) References Cited

U.S. PATENT DOCUMENTS

| | | | | |
|---|---|---|---|---|
| 5,148,226 | A | 9/1992 | Setoriyama et al. | |
| 5,210,579 | A | 5/1993 | Setoriyama et al. | |
| 5,525,775 | A | 6/1996 | Setoriyama et al. | |
| 6,546,223 | B2 | 4/2003 | Kishino et al. | |
| 8,688,023 | B2 | 4/2014 | Sekihara et al. | |
| 2010/0278558 | A1* | 11/2010 | Enoki ..... | G03G 21/0064 399/130 |
| 2012/0020709 | A1* | 1/2012 | Uchiyama ..... | G03G 15/206 399/333 |
| 2012/0269560 | A1 | 10/2012 | Sakakibara | |
| 2012/0315418 | A1* | 12/2012 | Nakajima ..... | G03G 15/2057 428/35.9 |

FOREIGN PATENT DOCUMENTS

| | | | |
|---|---|---|---|
| JP | 4-044075 | A | 2/1992 |
| JP | 4-044076 | A | 2/1992 |
| JP | 4-044077 | A | 2/1992 |
| JP | 4-044078 | A | 2/1992 |
| JP | 4-044079 | A | 2/1992 |
| JP | 4-044080 | A | 2/1992 |
| JP | 4-044081 | A | 2/1992 |
| JP | 4-044082 | A1 | 2/1992 |

(Continued)

OTHER PUBLICATIONS

Matsumoto Microsphere F Series Product Data Sheet, published 2008. http://www.mtmtys.co.jp/e/product/general/data01_2.html.*

*Primary Examiner* — Peter Vajda
(74) *Attorney, Agent, or Firm* — Fitzpatrick, Cella, Harper & Scinto

(57) ABSTRACT

The present invention is directed to providing an electrophotographic member including a conductive elastic layer having high thermal insulation properties and excellent dimensional stability. The electrophotographic member having an elastic layer which includes a plurality of voids derived from resin microballoons connected to and made open to each other and contains an ion conducting agent.

12 Claims, 4 Drawing Sheets

(56) References Cited

FOREIGN PATENT DOCUMENTS

| | | | |
|---|---|---|---|
| JP | 4-044083 | A1 | 2/1992 |
| JP | 4-204980 | A1 | 7/1992 |
| JP | 4-204981 | A1 | 7/1992 |
| JP | 4-204982 | A | 7/1992 |
| JP | 4-204983 | A | 7/1992 |
| JP | 4-204984 | A | 7/1992 |
| JP | 7-129008 | A | 5/1995 |
| JP | 2001-062380 | A | 3/2001 |
| JP | 2002-213432 | A | 7/2002 |
| JP | 3969942 | B2 | 9/2007 |
| JP | 4003042 | B2 | 11/2007 |

* cited by examiner

ELECTROPHOTOGRAPHIC MEMBER AND HEAT FIXING ASSEMBLY

BACKGROUND OF THE INVENTION

1. Field of the Invention

The present invention relates to an electrophotographic member for use in a fixing member of a heat fixing assembly in an electrophotographic image forming apparatus such as electrophotographic copier and electrophotographic printer, and a heat fixing assembly for use in an electrophotographic image forming apparatus.

2. Description of the Related Art

Products with reduced power consumption have recently been desired in the field of business machines. For a measure for reducing power consumption in an image forming apparatus such as electrophotographic copier and laser beam printer, the thermal capacity of a heat fixing unit has been made progressively reduced. Known examples of such an on-demand type heat fixing unit include the following (1) and (2).

(1) A heat fixing unit including a ceramic heater arranged inside a film-shaped rotating body and a pressure roller which co-operates with the ceramic heater through the film-shaped rotating body so as to form a heating nip part, where an image on a recording material is heated by heat from the ceramic heater in the nip part.

(2) An electromagnetic induction heating-type heat fixing unit in which a film-shaped rotating body or a fixing roller itself generates heat.

In these circumstances, further acceleration in the first print time and energy saving have been recently under way, requiring further shortening of the heating startup time and a reduction in power consumption of a fixing assembly, in particular. Consequently, the pressure roller for use in the heat fixing assembly is required to have "high thermal insulation properties". The idea is that the reduction in thermal conductivity of the elastic layer of the pressure roller allows the less heat quantity to be removed from the heating body through the pressure roller during starting up of the heat fixing assembly, so that the temperature increase rate of the film-shaped rotating body in contact with the pressure roller or the fixing roller can be improved.

A method in which air voids are arranged in the elastic layer of a pressure roller in order to lower the thermal conductivity of the elastic layer is a general method. A method in which resin microballoons are utilized as one of the materials is known. It is important that the voids in the elastic layer are formed of connected open-cell foams and open to the outside so that the change in the outer diameter of the pressure roller can be restricted. In the case that the voids are not formed of connected open-cell foams or not open to the outside, gas inside the voids expands when heated, so that the outer diameter of the pressure roller is changed. The change in the outer diameter of the pressure roller occurs later than the increase in surface temperature of the pressure roller, so that the control of pressure roller-driven paper transportation becomes unstable even with use of a common device for detecting the temperature under pressure.

In order to form an elastic layer having voids of connected foams from aggregates of resin microballoons, it is required that the resin microballoons are aggregated in a liquid rubber composition (Japanese Patent No. 3969942).

Meanwhile, the incorporation of an electron conducting agent (carbon black) into a roller having an elastic layer including voids of resin microballoons has been proposed for the purpose of reducing the electrical resistance of the elastic layer (Japanese Patent No. 4003042).

The surface of a pressure roller electrostatically charged by friction with a fixing roller to make a pair with the pressure roller or by friction with paper may cause paper to wind around the pressure roller or may generate a so-called electrostatic off-set image, i.e. electrostatically scattered toner on a sheet of paper, in some cases. In order to prevent the phenomenon, an elastic layer which is made electrically conductive has been proposed (Japanese Patent Application Laid-Open No. H07-129008).

The present inventors attempted to incorporate a conducting agent such as carbon black into a liquid rubber composition which contains resin microballoons and an aggregating agent so as to make an electrically conductive elastic layer of a pressure roller, having connected foam voids formed from aggregate of resin microballoons. As a result, the aggregation of the resin microballoons was inhibited in some cases due to interaction between the conducting agent and the aggregating agent.

The effect of a conducting agent on the aggregation of resin microballoons is a new problem which has never been conventionally recognized. The present inventors have recognized that the problem should be definitely solved for obtaining a fixing member having an elastic layer with high thermal insulation properties and high electrical conductivity.

SUMMARY OF THE INVENTION

The present invention is directed to providing an electrophotographic member including a conductive elastic layer having high thermal insulation properties and excellent dimensional stability.

The present invention is also directed to providing a heat fixing assembly for use in an electrophotographic image forming apparatus capable of stably heat fixing a toner image on a recording material such as paper.

According to an aspect of the present invention, there is provided an electrophotographic member comprising an elastic layer, wherein the elastic layer comprises a plurality of voids derived from resin microballoons, the voids being connected to and made open to each other, and contains an ion conducting agent.

According to another aspect of the present invention, there is provided a heat fixing assembly comprising a heating unit and a pressure member disposed opposed to the heating unit, allowing a recording material having an unfixed toner image supported thereon to be introduced between the heating unit and the pressure member for fixing the toner image on the recording material, wherein the pressure member is the above electrophotographic member.

Further features of the present invention will become apparent from the following description of exemplary embodiments with reference to the attached drawings.

DESCRIPTION OF THE EMBODIMENTS

Preferred embodiments of the present invention will now be described in detail in accordance with the accompanying drawings.

Heat Fixing Assembly

Figure 1:
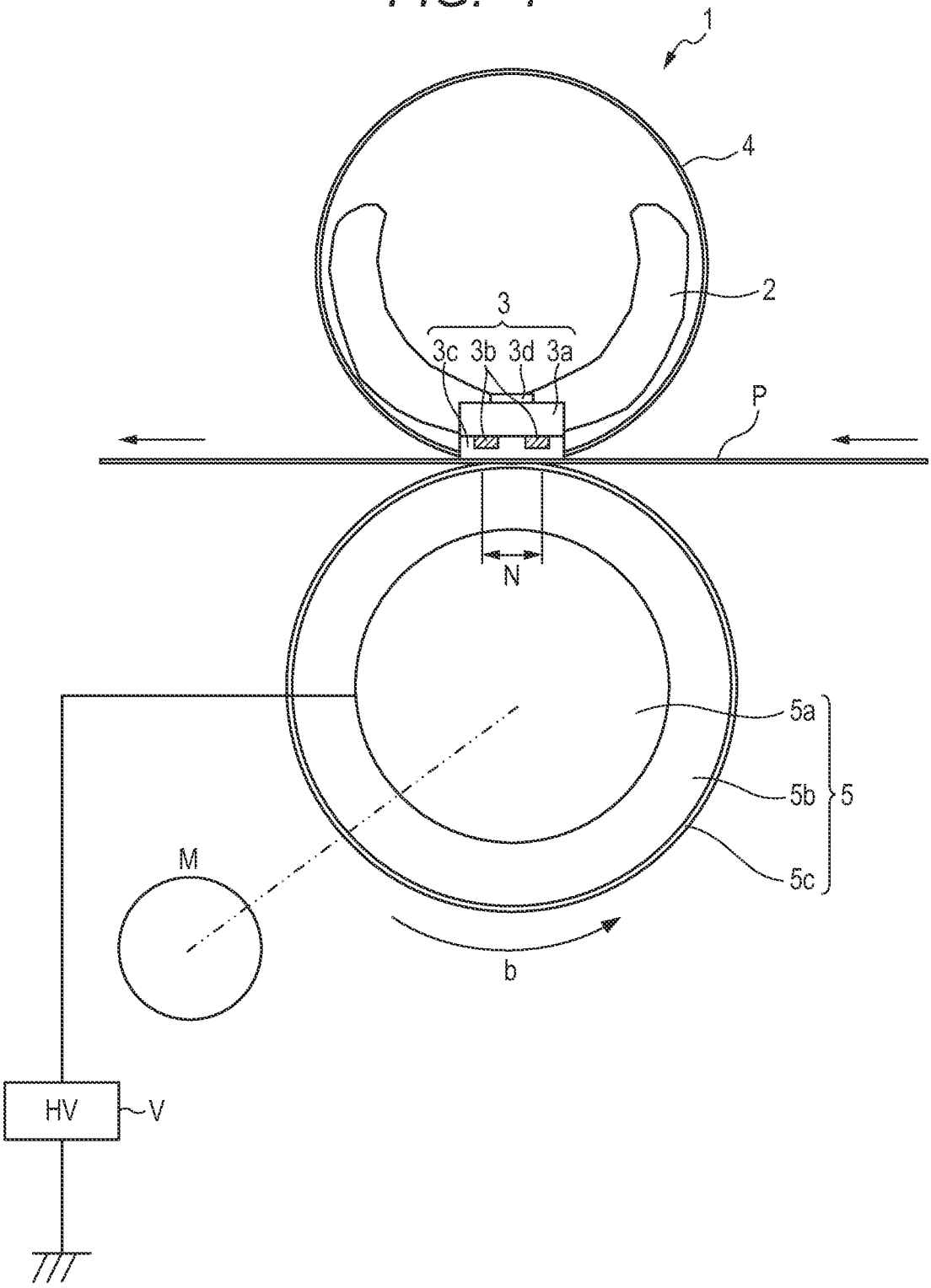
FIG. 1 is a schematic view of a fixing assembly of the present invention.

FIG. 1 is a schematic view of a fixing assembly 1 of the present invention. The heat fixing assembly of the present invention is a so-called tensionless-type heat fixing assembly with a film heating system and a pressure rotating body (pressure roller) driving system, which is described in Japanese Patent Application Laid-Open Nos. H04-044075 to 044083 and Nos. H04-204980 to 204984.

A reference numeral 2 represents a horizontally long film guide member (stay) having a transverse section of semicircle-shaped trough type, with a longitudinal direction perpendicular to the plane of the drawing. A reference numeral 3 represents a horizontally long heating body (heater) housed and held in a groove arranged along the longitudinal direction at the approximately central part of the bottom face of the film guide member 2. A reference numeral 4 represents a heat resistant film (flexible film) in an endless belt shape (cylindrical shape) which is loosely fitted onto the film guide member with the heating body. In the heat fixing assembly in FIG. 1, the film guide member 2, the heating body 3 and the heat resistant film 4 constitute a heating unit.

A reference numeral 5 represents a pressure roller as the pressure member in contact with the heat resistant film 4, which constitutes a part of the heating unit. The pressure contact allows the elastic layer of the pressure roller 5 to be elastically deformed, so that a pressure contact nip part (fixing nip part) N can be formed between the pressure roller 5 and the heating body 3. The pressure roller 5 is rotary-driven in the arrow b direction (counterclockwise direction) at a predetermined circumferential velocity by the driving force of a driving source M transmitted through a power transmission mechanism such as gears not shown in drawing.

The film guide member 2 is a molded product of heat resistant resin such as polyphenylene sulfide (PPS) or liquid crystal polymers.

The heating body 3 is a ceramic heater having a low heat capacity. The ceramic heater includes a substrate 3*a* of alumina or AlN in a horizontally long and thin plate-like shape, an electrical conduction heating body (resistance heating element) 3*b* of Ag/Pd in a linear or narrow strip shape arranged on the surface side (film sliding surface side) of the substrate along the longitudinal direction, a thin surface protective layer 3*c* formed of a glass layer or the like, and a temperature detecting element 3*d* such as thermistor arranged on the rear side of the substrate 3*a*. The ceramic heater is controlled such that a predetermined fixing temperature (control temperature) is maintained with a power control system including the temperature detecting element 3*d* after rapid increase in temperature with power supply to the electrical conduction heating body 3*b*.

The heat resistant film 4 is a composite layer film having a gross film thickness of, for example, 400 μm or less, preferably 50 μm or more and 300 μm or less, such that the small heat capacity improves the quick start ability of an apparatus. The base layer of the heat resistant film 4 is formed of, for example, a heat resistant resin such as polyimide, polyamideimide, and PEEK, or a metal member having heat resistance and high thermal conductivity such as SUS, Al, Ni, Ti, and Zn, alone or in combination with each other. An elastic layer for improving the toner fixing performance may be arranged on the base layer. Examples of the preferred material for the elastic layer include a silicone rubber and a fluoro rubber, to which a thermal conductive filler, a reinforcing material and the like are added.

A release layer can be formed on the base layer, or on the elastic layer formed on the base layer in the case of having the elastic layer on the base layer. The release layer may contain the following fluororesin: tetrafluoroethylene-perfluoro (alkyl vinyl ether) copolymer (PFA), polytetrafluorethylene (PTFE), tetrafluoroethylene-hexafluoropropylene copolymer (FEP), and the like. The fluororesins may be used alone, or in combination of two or more. Among the fluororesins, PFA is particularly preferred, having excellent moldability, heat resistance and flex resistance.

The release layer may contain a conductive member such as carbon black and an ion conducting substance, on an as needed basis.

The pressure roller 5 includes a substrate 5*a* of material such as iron or aluminum, a rubber elastic layer 5*b*, and a release layer 5*c*.

Since the pressure roller 5 is rotary-driven in the arrow b direction (counterclockwise direction) during image formation, the heat resistant film 4 follows the rotation of the pressure roller 5. In other words, the driven pressure roller 5 allows a rotating force to be applied to the heat resistant film 4 due to the friction force between the pressure roller 5 and the outer surface of the heat resistant film 4 in the fixing nip part N. During the rotation of the heat resistant film 4, the inner surface of the heat resistant film 4 slides in close contact with the lower surface (surface protective layer 3*c*) of the heating body 3 in the fixing nip part N. In order to reduce the sliding resistance between the inner surface of the heat resistant film 4 and the lower surface of the heating body 3, i.e. the surface protective layer 3*c*, on which the inner surface of the heat resistant film 4 slides, it is preferred to interpose a lubricant agent having excellent heat resistance between both surfaces.

In order to prevent the occurrence of electrostatic offsetting, a voltage can be applied to the pressure roller 5, with a voltage application circuit V. In the case of the elastic layer 5*b* of the pressure roller 5 having conductivity or antistatic performance, the potential at immediately under the release layer can be easily controlled. Corresponding to the charging polarity of toner, the voltage having a polarity for attracting toner to paper may be applied. The electrical contact point to the pressure roller 5 is not specifically limited. The method having a contact point on the substrate 5*a* is preferred, in view of the stability of conduction.

The recording material P introduced in the fixing nip part N is held with the heating unit and the pressure roller so as to be transported. On this occasion, the unfixed toner image on the recording material P is heated with the heating unit so as to be fixed on the recording material P. The recording material P passing through the fixing nip part N is detached from the outer surface of the heat resistant film 4 so as to be transported.

A heating body having a small heat capacity and a high temperature increase rate can be used in the film heating-type fixing assembly of the present case, so that the time for the heating body to reach a predetermined temperature can be significantly shortened. Since the increase from normal temperature to higher temperature can be easily performed, standby temperature control is not required during standby state of an apparatus in no printing operation, resulting in power saving.

Except for the fixing nip part, practically no tension is applied to the rotating heat resistant film. As a film deviation movement restricting unit, only a flange member for simply receiving the end part of the heat resistant film is arranged.

Electrophotographic Member

The electrophotographic member of the present invention may be used as a pressure roller, a fixing roller, and a heat resistant film in a heat fixing assembly. The constituent material and the molding method for the pressure roller as a representative example are described in detail in the following.

Pressure Roller

A pressure roller 5 illustrated in FIG. 1 includes a substrate 5*a*, and at least an elastic layer 5*b* and a release layer 5*c* laminated along the outer periphery of the substrate 5*a*. The elastic layer 5*b* including a soft and heat resistant material as typified by a silicone rubber has electrical conductivity and excellent antistatic performance. The release layer 5*c* is a layer made of a material suitable for the surface of a pressure roller, typified by, for example, a fluororesin or a fluoro rubber.

Substrate

Examples of the material for the substrate 5*a* include a metal and an alloy such as aluminum, iron and stainless steel. Examples of the shape of the substrate include a hollow cylindrical shape and a solid columnar shape. The hollow cylindrical shaped substrate may have a heat source inside thereof. On the outer peripheral surface of the substrate in a columnar or cylindrical shape, a functional layer (not shown in drawing) for enhancing the adhesion between the substrate and the elastic layer may be further provided.

In general, at one end or both ends of the substrate in the longitudinal direction, a gear for imparting rotational driving force and a cutout for mounting the gear may be formed in some cases. A bearing and a shaft bush for reducing torque during rotation may be set on an as needed basis.

Elastic Layer

Figure 2:
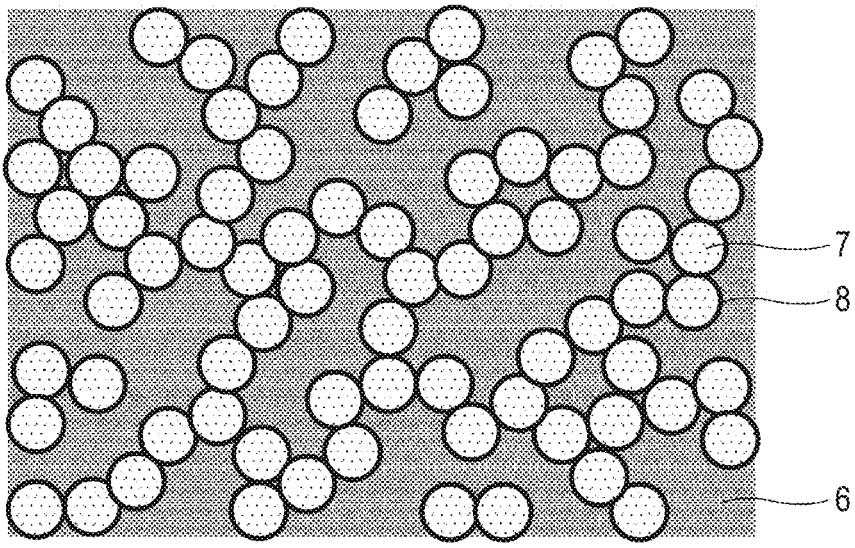
FIG. 2 is a schematic enlarged cross-sectional view of a molded rubber product after primary cross-linking.
Figure 3:
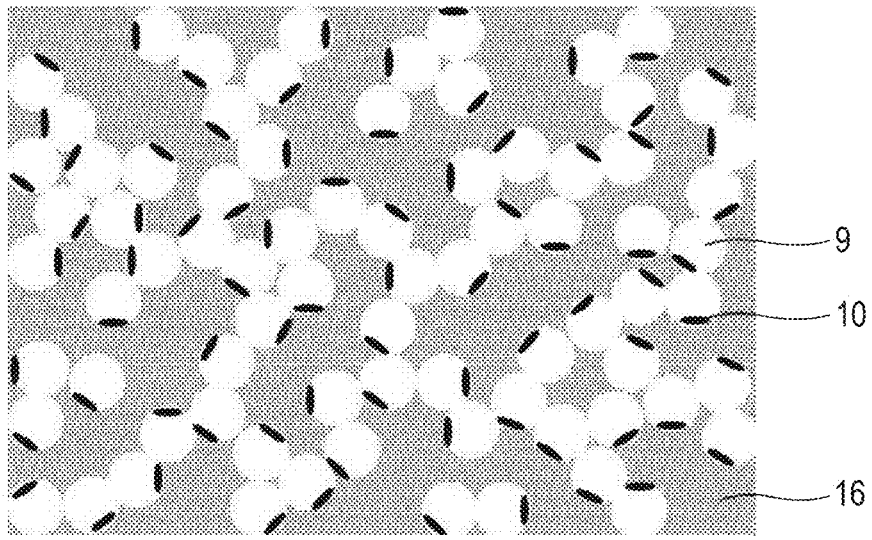
FIG. 3 is a schematic enlarged cross-sectional view of an elastic layer of the present invention.
Figure 4:
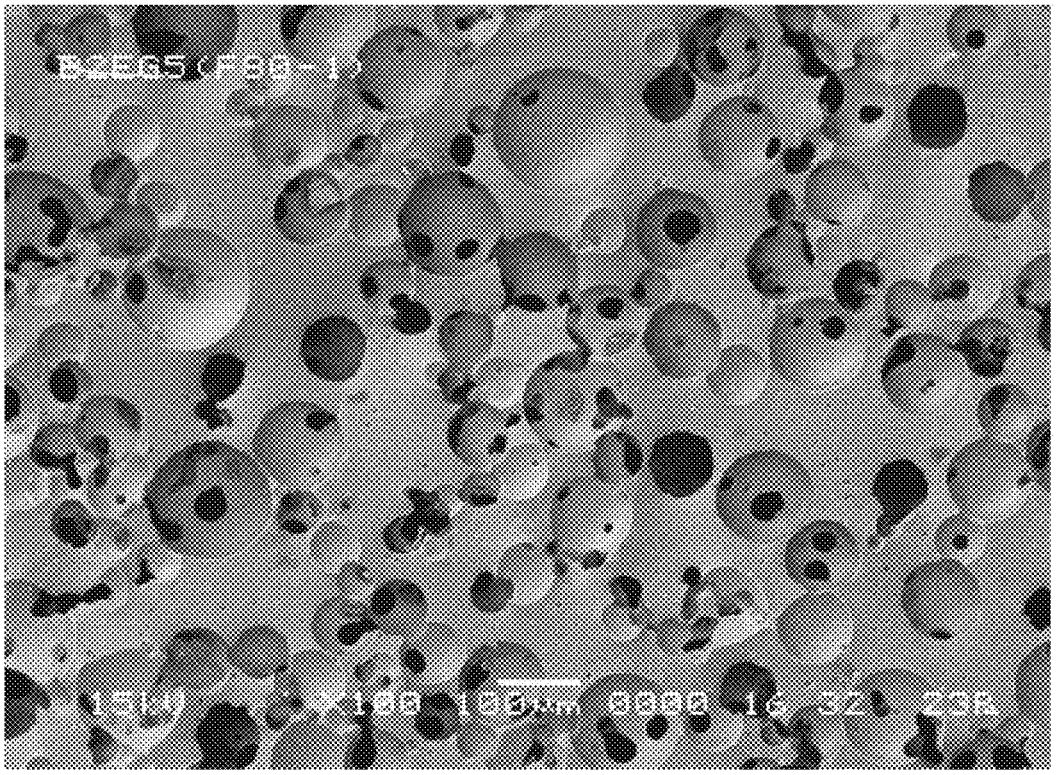
FIG. 4 is a scanning electron microscope (SEM) photograph of a cross-section of an elastic layer of the present invention.

The material to constitute an elastic layer can be a cured material of an elastic layer forming rubber composition which contains resin microballoons, an ion conducting agent, and an aggregating agent for the resin microballoons. The elastic layer may be formed by, for example, the following procedure. Firstly, a liquid rubber in an uncross-linked state is prepared as a base rubber material. Resin microballoons, an aggregating agent for the resin microballoons, and an ion conducting agent are added to the liquid rubber to be mixed and agitated, so that an elastic layer forming rubber composition is obtained. Subsequently, a cross-link reaction of the liquid rubber at the primary cross-linking temperature produces a molded rubber product in a state, as illustrated in FIG. 2, in which the resin microballoons 7 in the base rubber material 6 are aggregated and dispersed to be serially linked in a row, so-called in a beaded arrangement, through the aggregating agent 8. The molded rubber product is then heated at a temperature equal to or higher than the decomposition temperature of the resin microballoons, so that the resin microballoons are broken and contracted. Consequently, an elastic layer can be obtained, including a plurality of open voids 9 which are connected to each other as illustrated in FIG. 3 and an ion conducting agent. A reference numeral 10 in FIG. 3 represents a residue of shell formed from broken resin microballoons. A heat resistant rubber 16 includes the contracted residue in the vicinity of the wall of the voids 9 formed after the foam breakage. A scanning electron microscope (SEM) photograph of a cross-section of the elastic layer is given in FIG. 4.

<Aggregating Agent>

It is important for an aggregating agent for the resin microballoons to have high affinity with the resin microballoons and low affinity with the liquid rubber as base rubber material. This allows the aggregating agent attached to the surface of the resin microballoons to be dispersed in the liquid rubber, so that the function for connecting the resin microballoons to each other can be exhibited. As a result, the resin microballoons dispersed in the base rubber material are linked serially in a row as illustrated in FIG. 2. Since the state of resin microballoons linked in a row is maintained in a heat resistant rubber produced from cross-linking reaction of liquid rubber, a plurality of voids connected to and made open to each other, derived from the resin microballoons are formed in the elastic layer.

The aggregating agent for use can be a polyol, in view of the affinity with resin microballoons. Examples of the typical polyol include: ethylene glycol, diethylene glycol, triethylene glycol, tetraethylene glycol, polyethylene glycol, propylene glycol, dipropylene glycol, tetramethylene glycol, glycerin and pentaerythritol.

Alternatively, a specific ionic liquid may be added as ion conducting agent so as to simultaneously serve as an aggregating agent. The specific ionic liquid for use can be at least one of a perfluoroalkyl sulfonate ion having 4 or more and 10 or less carbon atoms and a perfluoroalkyl sulfonimide ion having 1 or more and 4 or less carbon atoms. The ionic liquid having such an anion species has high affinity with resin microballoons and low affinity with liquid rubber, having a function as aggregating agent as well.

<Resin Microballoon>

Examples of the resin microballoons include acrylonitrile resin microballoons, vinylidene chloride resin microballoons, and phenol resin microballoons. In view of dispersibility, acrylonitrile resin microballoons are preferred. The resin microballoons have a structure having a gas such as hydrocarbon enclosed inside a shell formed of the resin. The resin microballoons in an unexpanded state and the resin microballoons in an expanded state have been placed on the market. The resin microballoons in an expanded state are preferred for use in a dispersed state in a base rubber material, in view of dimensional stability during forming.

The resin microballoons having a proper decomposition temperature can be suitably selected corresponding to the cross-linking temperature of the rubber for use. For example, in the case of using an addition curing liquid silicone rubber as the base rubber material in an elastic layer forming rubber composition, resin microballoons which cause no foam breakage at the primary cross-linking temperature (about 100° C.) of the liquid silicone rubber and cause foam breakage at the secondary cross-linking temperature (about 200° C.) are suitably used.

The resin microballoons have an average particle diameter of 10 μm or more and 200 μm or less, preferably 10 μm or more and 150 μm or less. Use of the resin microballoons in the range allows the rubber elasticity and rubber strength to be suitably maintained. The average particle diameter means an arithmetic mean value of [((major axis)+(minor axis))/2] for 100 pieces of the resin microballoons randomly selected in the field of view by microscopic observation.

The blending quantity of the resin microballoons can be 10 vol. % or more and 60 vol. % or less relative to the elastic layer forming rubber composition. The blending quantity in the range allows the rubber elasticity and the rubber strength to be suitably maintained.

<Ion Conducting Agent>

As an ion conducting agent for use in the present invention, a lithium salt and an ionic liquid can be used. In particular, an ionic liquid is preferred, having excellent dispersibility in a liquid rubber so that the elastic layer can be efficiently made conductive. The ion conducting agent can have a decomposition temperature of 200° C. or higher, so as to stably exist after the secondary cross-linking of rubber.

Examples of the lithium salt include $LiBF_4$, $LiPF_6$, $LiAsF_6$, $LiClO_4$, $LiSO_3CF_3$, $LiSO_3F_4F_9$, $LiN(SO_2CF_3)_2$ and $LiN(SO_2C_4F_9)_2$.

The ionic liquid means a salt in a liquid form, most commonly having a melting point of 100° C. or lower. Use of a relatively large organic ion as an ion species for constituting the salt allows for a liquid state at a relatively low temperature. There exist various kinds of ionic liquid with combination of cation species and anion species as follows.

Examples of the commonly used cation species to be contained in an ionic liquid include an imidazolium-based ion, a pyridinium-based ion, and an ammonium-based ion.

Examples of the imidazolium-based ion include: 1-alkyl-3-methylimidazolium ion (BMI) represented by the following formula (1) (e.g. 1-ethyl-3-methylimidazolium ion (EMI), 1-butyl-3-methylimidazolium ion (BMI), 1-hexyl-3-methylimidazolium ion (HMI)); and 1-alkyl-2,3-dimethylimidazolium ion (RDMI) represented by the following formula (2) (e.g. 1-ethyl-2,3-dimethylimidazolium ion (EDMI), 1-butyl-2,3-dimethylimidazolium ion (BDMI), and 1-hexyl-2,3-dimethylimidazolium ion (HDMI)). In the formulae (1) and (2), R represents an alkyl group.

(1)

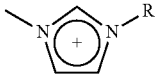

(2)

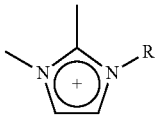

Examples of the pyridinium-based ion include: 1-alkyl pyridinium ion (RPy) represented by the following formula (3) (e.g. 1-ethylpyridinium ion (EtPy), 1-butylpyridinium ion (BuPy), and 1-hexylpyridinium ion (HexPy)); and 1-alkyl-3-methylpyridinium ion (RMePy) represented by the following formula (4) (e.g. 1-ethyl-3-methylpyridinium ion (EtMePy), and 1-butyl-3-methylpyridinium ion (BuMePy)). In the formulae (3) and (4), R represents an alkyl group.

(3)

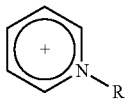

(4)

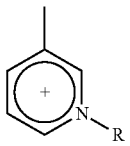

An asymmetrical quaternary ammonium salt is usually used as ammonium-based ion, including, for example, N,N,N-trimethyl-N-propylammonium ion (TMPA) represented by the following formula (5); N,N-diethyl-N-methyl-N-(2-methoxyethyl)ammonium ion represented by the following formula (6); 1-methyl-1-propylpyrrolidinium ion (P1.3) represented by the following formula (7); 1-methyl-1-butylpyrrolidinium ion (P1.4) represented by the following formula (8); and N-methyl-N-propylpiperidinium ion (PP1.3) represented by the following formula (9).

(5)

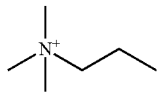

(6)

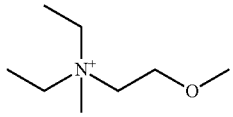

(7)

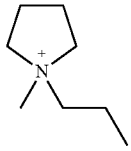

(8)

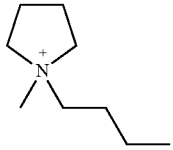

(9)

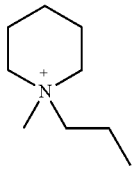

On the other hand, an inorganic ion and an organic ion may be used as anion species contained in an ionic liquid. Examples of the widely used inorganic ion include $Cl^-$, $Br^-$, $I^-$, $BF_4^-$, $PF_6^-$, and $HSO_3^-$.

Examples of the organic ion include the following: an alkyl sulfate ion represented by the following formula (10) (e.g. methyl sulfate ion and ethyl sulfate ion); a perfluoroalkyl sulfonate ion represented by the following formula (11) (e.g. trifluoromethane sulfonate ion (EF11), perfluoroethane sulfonate ion (EF21), perfluoropropane sulfonate ion (EF31), perfluorobutane sulfonate ion (EF41), perfluorohexane sulfonate ion (EF61), perfluorooctane sulfonate ion (EF81), and perfluorodecane sulfonate ion (EF101)); and a perfluoroalkyl sulfonimide ion represented by the following formula (12) (e.g. bis(trifluoromethane sulfonyl)imide ion (N111), bis(perfluoroethane sulfonyl)imide ion (N221), bis(perfluoropropane sulfonyl)imide ion (N331), bis(perfluorobutane sulfonyl)imide ion (N441), trifluoromethane sulfonyl-perfluoropropane sulfonyl-imide ion (N131), and trifluoromethane sulfonyl-perfluorobutane sulfonyl-imide ion (N141)).

In the formula (10), R represents an alkyl group, and in the formula (11), $R_f$ represents a perfluoroalkyl group. In the formula (12), $R_{f1}$ and $R_{f2}$ each represent independent a perfluoroalkyl group.

(10)

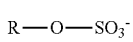

(11)

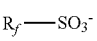

-continued (12)

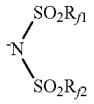

As described in the paragraph "Aggregating agent", the present inventors found that an ionic liquid including a perfluoroalkyl sulfonate ion having 4 or more and 10 or less carbon atoms (e.g. EF41, EF61, EF81 and EF101) and a perfluoroalkyl sulfonimide ion having 1 or more and 4 or less carbon atoms (e.g. N111, N221, N331, N441, N131 and N141) as an anion exhibits the function as an aggregating agent.

<Base Rubber Material>

The elastic layer 5*b* pressure contacted with an opposed member functions as a layer which allows a fixing member to support the elasticity for forming a fixing nip. A heat resistant rubber such as silicone rubber and fluoro rubber can be used as a base rubber material for exhibiting the function. Among them, an addition curing silicone rubber is particularly preferred. Since an addition curing silicone rubber is usually in a liquid state before curing, resin microballoons, an ion conducting agent, and an aggregating agent can be easily dispersed in a base rubber material, and the elasticity of the elastic layer may be adjusted by adjusting the degree of cross-linking.

In general, an addition curing silicone rubber includes an organopolysiloxane having an unsaturated aliphatic group, an organopolysiloxane having active hydrogen bonded to silicon, and a platinum compound as a cross-linking catalyst.

Examples of the organopolysiloxane having an unsaturated aliphatic group include the following (1) and (2).

(1) Straight-chain organopolysiloxane in which both molecular ends are represented by $R^1{}_2R^2SiO_{1/2}$ and the intermediate units are represented by $R^1{}_2SiO$ and $R^1R^2SiO$.

(2) Branched polyorganosiloxane in which the intermediate units include $R^1SiO_{3/2}$ or $SiO_{4/2}$.

In the formulae, $R^1$ represents a monovalent unsubstituted or substituted hydrocarbon group bonded to a silicon atom, which includes no aliphatic unsaturated group. Specific examples of the group include the following (i) to (iii).

(i) Alkyl group (e.g. methyl, ethyl, propyl, butyl, pentyl and hexyl);

(ii) Aryl group (e.g. phenyl);

(iii) Substituted hydrocarbon group (e.g. chloromethyl, 3-chloropropyl, 3,3,3-trifluoropropyl, 3-cyanopropyl and 3-methoxypropyl).

Due to excellent heat resistance with the easiness in synthesis and handling, preferably 50% or more of $R^1$ is a methyl group, most preferably all of the $R^1$ is a methyl group. In the formula, $R^2$ represents an unsaturated aliphatic group bonded to a silicon atom. Examples of the group include a vinyl group, an allyl group, a 3-butenyl group, a 4-pentenyl group and a 5-hexenyl group. Among them, a vinyl group is preferred due to the easiness in synthesis and handling, allowing a cross-linking reaction to be easily performed.

The organopolysiloxane having active hydrogen bonded to a silicon atom is a cross-linking agent which forms a cross-linking structure by a reaction with an alkenyl group of the organopolysiloxane component having an unsaturated aliphatic group through the catalytic action of a platinum compound. The number of hydrogen atoms bonded to a silicon atom exceeds 3 on average in a molecule. Examples of the organic group bonded to the silicon atom include an unsubstituted or substituted monovalent hydrocarbon group which is in the same range for the $R^1$ of the organopolysiloxane component having an unsaturated aliphatic group. In particular, a methyl group is preferred due to the easiness of synthesis and handling. The molecular weight of the organopolysiloxane having active hydrogen bonded to silicon is not specifically limited The viscosity of the organopolysiloxane at 25° C. is in the range of preferably 10 mm/s or more and 100,000 $mm^2/s$ or less, more preferably 15 m/s or more and 1,000 $mm^2/s$ or less. The reasons are that the organopolysiloxane in the range causes no volatilization during storage for obtaining a desired cross-linking degree and physical properties of a molded product, and allows for easy dispersion in the system due to the easiness in synthesis and handling.

The siloxane skeleton may be straight-chain, branched, cyclic, or a mixture thereof. In particular, a straight-chain type is preferred due to the easiness of synthesis. The Si—H bonds may exist in any siloxane unit of a molecule. At least a part of the bonds can exist in a siloxane unit at a molecular end such as $R^1{}_2HSiO_{1/2}$ unit.

As an addition curing silicone rubber, the amount of unsaturated aliphatic group can be 0.1 mol % or more and 2.0 mol % or less relative to 1 mol of the silicon atom. The amount of 0.2 mol % or more and 1.0 mol % or less is particularly preferred.

Release Layer

Examples of the material for constituting the release layer 5*c* include a fluoro rubber or a fluororesin, in view of the release properties of toner. In particular, a fluororesin is preferred. Examples of the fluororesin include the following resins: a tetrafluoroethylene-perfluoro(alkyl vinyl ether) copolymer (PFA), polytetrafluorethylene (PTFE), and a tetrafluoroethylene-hexafluoropropylene copolymer (FEP).

Among the exemplary materials described above, PFA is preferred in view of the moldability and toner release properties. The release layer may contain a filler for controlling thermophysical properties within the range not impairing the moldability and release properties.

The thickness of the release layer formed of the fluororesin can be 10 μm or more and 100 μm or less. The release layer having the thickness in the range hardly causes cracks due to the thermal expansion of the substrate and the elastic layer, and the excessive increase in hardness of a pressure roller can be avoided.

Manufacturing Method for Pressure Roller

The forming method or manufacturing method for a roller is widely known. The pressure roller may be formed by the known method as long as the requirements for the invention are satisfied.

The processing methods of the elastic layer are widely known, including a die molding method, a blade coating method, a nozzle coating method, and a ring coating method, as disclosed in Japanese Patent Application Laid-Open Nos. 2001-062380 and 2002-213432. The mixture supported on a substrate by any of these methods is heated and cross-linked to form the elastic layer. In particular, a die molding method is preferred, being hardly influenced by the dimensional change during forming, and allows for integral molding of a release layer. Although split dies and cylindrical dies may be utilized in molding, cylindrical dies are preferred, which does not cause parting lines to occur during forming.

In the case of using a cylindrical die, a cylindrical or columnar substrate with pretreatment such as bonding is inserted inside the cylindrical die and a bridge having an inlet and an outlet for holding the substrate is arranged at both ends. In the case of integral molding of a release layer, a separately formed fluororesin tube with the bonding treated inner surface may be extended on the inner surface of the cylindrical die prior to the arrangement of the bridge.

Subsequently an elastic layer forming rubber composition including resin microballoons, an ion conducting agent, an aggregating agent, and the like which are kneaded in advance is pressure-injected into the cylindrical die from the inlet side. On this occasion, a die with an enclosed structure may cause the resin microballoons to be compressed and deformed by the mold casting pressure. Accordingly casting can be performed in an open outlet state. After confirmation of the outflow of the elastic layer forming rubber composition from the outlet, the inlet and the outlet are closed in a state where approximately no residual pressure exists. The die is then heated to the primary cross-linking temperature of the rubber, with a heating platen or an electrical oven.

After completion of the primary cross-linking of rubber, the bridge arranged both ends of the cylindrical die is unfastened, so that the roller is removed from the die. The roller removed from the die is heated at the secondary cross-linking temperature of rubber, so that the resin microballoons are broken by heating. Consequently the voids formed from the resin microballoons are serially linked to form connected open-cell foams.

In the case of not integrally forming a release layer with the elastic layer, the release layer may be formed through an adhesive after secondary cross-linking.

The present invention provides an electrophotographic member including an elastic layer having voids formed of connected foams derived from the aggregate of resin microballoons, and conductivity. In other words, a useful electrophotographic member can be provided, which reduces change in the outer diameter caused by expansion of the holes when heated, and prevents the charging of the member surface by dissipating charges generated by the friction with paper or an opposing member.

EXAMPLES

The present invention is more specifically described with Examples below. The scope of the present invention is, however, not limited to the following Examples.

Example 1

1. Manufacturing of Pressure Roller

Relative to 100 mass parts of a commercially available addition curing silicone rubber liquid concentrate (trade name: SE1740, made by Dow Corning Toray Co., Ltd.), 2 mass parts of expanded acrylonitrile-based copolymer resin microballoons (trade name: MATSUMOTO MICROSPHERE F-80DE, made by Matsumoto Yushi-Seiyaku Co., Ltd) as resin microballoons were blended. Furthermore, an ionic liquid, perfluorobutanesulfonate-1-ethyl-3-methylimidazolium (EMI-EF41) was blended as a combination of an ion conducting agent and an aggregating agent in an amount of 0.2 mol/Kg relative to the silicone rubber liquid concentrate. The mixture was sufficiently mixed and agitated to produce an elastic layer forming rubber composition.

The expanded acrylonitrile-based copolymer resin microballoons (trade name: MATSUMOTO MICROSPHERE F-80DE, made by Matsumoto Yushi-Seiyaku Co., Ltd) for use cause no foam breakage at the primary cross-linking temperature (about 100° C.) of the addition solidifying liquid silicone rubber, but cause foam breakage at the second cross-linking temperature (200° C.). The volume ratio of the resin microballoons relative to the produced elastic layer forming rubber composition is 40 vol. %.

On the other hand, a cylindrical stainless steel die with an inner diameter of 20 mm of which the inner surface was provided with an extended fluororesin (PFA) tube of 30 μm with inner surface bonding treatment was prepared. A bonding treated, solid columnar substrate of aluminum with an outer diameter of 13 mm was inserted inside the cylindrical die, and the bridges having an inlet and an outlet, respectively, were arranged at both ends, so that a die for cast molding a roller was prepared.

Subsequently, the die for cast molding was fastened such that the inlet was located at a lower position, and the prepared elastic layer forming rubber composition was pressure injected from the inlet. When the elastic layer forming rubber composition was discharged from the outlet located at a higher position of the die for the cast molding, the inlet was closed. The die was left alone for a while until the residual pressure escaped, and then the outlet was closed. The die for cast molding in the state was arranged on a heating platen under temperature control at 120° C. for the primary cross-linking for 30 minutes. Subsequently the die was cooled down to room temperature, and the bridges at both ends were removed. The roller having a primary cross-linked rubber layer formed around the outer periphery of the substrate was removed from the die for cast molding.

Subsequently, the roller was heated in an electric oven under temperature control at 200° C. for 4 hours for the secondary cross-linking, so that the electrophotographic pressure roller No. 1 of the present invention was obtained.

2. Evaluation of Performance of Pressure Roller

The produced pressure roller was evaluated as follows. The evaluation results of the pressure roller No. 1 are shown in Table 1.

(2-1. Evaluation of Antistatic Performance)

The antistatic performance of the elastic layer of a pressure roller may be confirmed based on the evaluation of the electrostatic offset image by feeding paper through an image forming apparatus. In the case of elastic layer of a pressure roller having low antistatic performance, due to the friction between the release layer of the pressure roller and a fixing film opposed to the pressure roller or a sheet of paper, the surface of the pressure roller is charged electrostatically, so that the toner on a sheet of paper is electrostatically scattered, generating an electrostatic offset image. On the other hand, in the case of elastic layer of a pressure roller having high antistatic performance, the potential can be controlled to the vicinity of the release layer of the elastic layer of a pressure roller, so that the generation of an electrostatic offset image can be prevented.

The specific evaluation procedure is described in the following. A fixing unit to which the pressure roller No. 1 was attached was incorporated in a laser beam printer (LBP, A4, 35 sheets/min). The sheets of papers NEENAH BOND (60 g/m$^2$) made by Neenah Paper Inc. were left alone in a low temperature and low humidity environment (temperature: 15° C., relative humidity: 10%). A half-tone image pattern was evaluated on the electrostatic offset for continuous feeding of 50 sheets. The toner for use in the present evaluation is a negative toner which has properties to be charged in the negative polarity. A voltage of +500 V was applied to the substrate of the pressure roller. The evaluation results were ranked based on the following criteria.

A: No electrostatic offset image was generated at all.

B: Some partial electrostatic offset images were rarely generated, causing no problem for use.

C: Bad-looking electrostatic offset images were generated.

(2-2. Evaluation of Connected Open-Cell Foams)

The measurement of change in the outer diameter of a pressure roller left alone in vacuum allows for the evaluation of the connected open-cell foams of an elastic layer of a pressure roller. A pressure roller with poorly connected foams of the elastic layer left in vacuum expands, and the state with increased outer diameter is maintained for long hours due to the slow escape of the interior gas. The outer diameter of a pressure roller with well connected foams temporarily increases and returns rapidly due to fast escape of the interior gas. A pressure roller with poorly connected foams is directly influenced by the thermal expansion of the interior gas, resulting in large variation in the outer shape due to the change in temperature.

The pressure roller is placed in a vacuum chamber, and the thickness of the elastic layer is continuously measured before pressure reduction, during pressure reducing, and after pressure reduction. The increment in the thickness of the elastic layer after pressure reduction (during pressure reducing) to the thickness of the elastic layer before pressure reduction is represented by $\Delta t$.

The pressure roller having reduced variation in the outer diameter for the change in environmental temperature can satisfy the following conditions. When a pressure roller is placed in a vacuum chamber which reaches a pressure of 0.001 MPa from the atmospheric pressure within 2 minutes, the pressure roller can have gas permeability such that the increment $\Delta t$ (10) in the thickness of the elastic layer at 10 minutes after the start of pressure reduction returns to ⅔ or less of the maximum increment $\Delta t$ (max) in the thickness of the elastic layer during the 10-minute period from the start of pressure reduction. It is believed that the voids in the elastic layer include sufficiently connected foams with the ratio of ⅔ or less. The variation in the outer diameter of such a pressure roller is more reliably restricted for the change in temperature in practical use.

Figure 5:
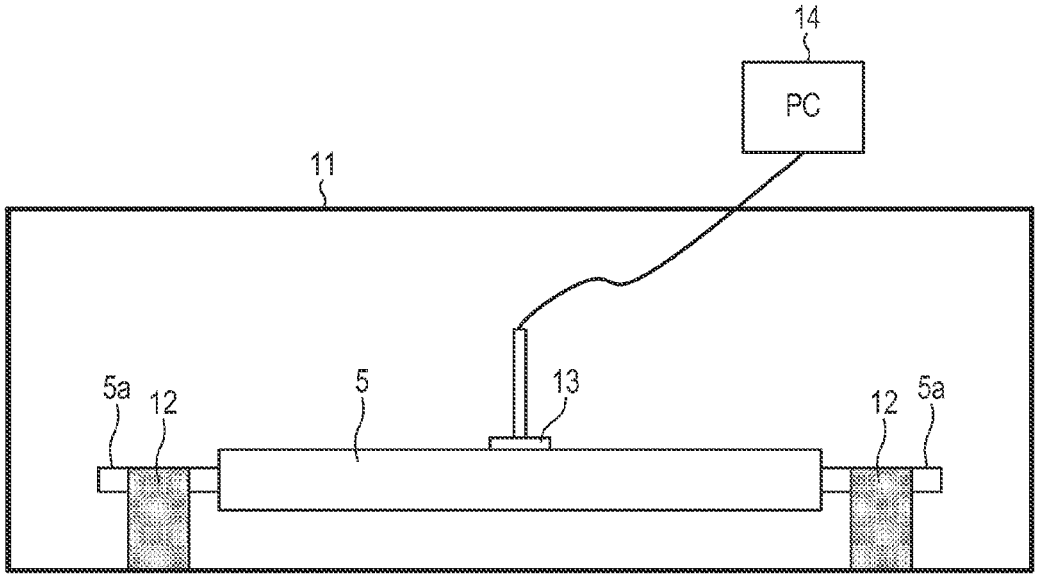
FIG. 5 is a diagram illustrating an apparatus for measuring the increment in the thickness of an elastic layer.

The vacuum chamber is not specifically limited as long as the measurement can be performed. A schematic diagram of an apparatus for measuring the increment in the thickness of an elastic layer is illustrated in FIG. 5. A reference numeral 11 represents a vacuum chamber formed of an acrylic resin or the like, a reference numeral 12 represents a support table for arranging the pressure roller 5, a reference numeral 13 represents a sensing probe for measuring a displacement amount (outer diameter variation sensing probe), and a reference numeral 14 represents a PC for monitoring the variation in displacement. The variation in thickness of the elastic layer of the pressure roller can be measured with the sensing probe for measuring displacement amount. In general, the thicknesses of layers other than the elastic layers exhibit no change for pressure reduction, so that the variation in the thickness of the elastic layer can be measured by the present measurement.

The specific evaluation procedure is described in the following. A pressure roller was placed in a vacuum chamber in which the pressure was reduced to 0.001 MPa or less within 2 minutes after the start of pressure reduction and maintained at 0.001 MPa or less for 10 minutes after the start of pressure reduction. On this occasion, the variation in thickness of the elastic layer was measured before the pressure reduction and during the 10-minute period from the start of pressure reduction. The evaluation results were ranked based on the following criteria.

A: $\Delta t(10)/\Delta t(max)$ is ⅔ or less.

C: $\Delta t(10)/\Delta t(max)$ is more than ⅔.

(2-3. Evaluation on Durability)

In heat durability testing of a pressure roller, due to the influence of various materials added to the elastic layer of the pressure roller, the adhesion between the elastic layer and the release layer is inhibited in rare cases. The evaluation is a paper feeding durability evaluation for confirming the influence of a conducting agent and an aggregating agent on the adhesion between the elastic layer and the release layer of a pressure roller.

The specific evaluation procedure is described below. The heating temperature of the ceramic heater in a fixing assembly of the LBP was set at 200° C. Paper feeding of 250,000 sheets of LTR vertical size paper (75 g/m$^2$) was performed at 35 sheets/min, and detachment of the release layer of the pressure roller was visually confirmed. Evaluation results were ranked based on the following criteria.

A: No problem occurred for feeding of 250,000 sheets.

B: No problem occurred for feeding of 200,000 sheets. Although partial detachment occurred for feeding of 250,000 sheets, no problem occurred in practical use.

Examples 2 to 8

Pressure rollers Nos. 2 to 8 were obtained by the same procedure as in Example 1, except that the type of the ion conducting agent was changed as shown in Table 1. The pressure rollers were evaluated in the same way as in Example 1. The evaluation results are shown in Table 2. In Table 1, the cation species and anion species are shown in symbols. The names of substances represented by each of the symbols are shown in Table 3. Further, combinations of the anion species and the cation species in Table 1 mean the ionic liquids shown in Table 4.

Examples 9 to 15

An elastic layer forming rubber composition was obtained in the same way as in Example 1, except that the type of the ion conducting agent was changed as shown in Table 1, and 5 mass parts of triethylene glycol (TEG) was blended as aggregating agent. Pressure rollers Nos. 9 to 15 were obtained by the same procedure as in Example 1 for the subsequent steps. The pressure rollers were evaluated in the same way as in Example 1. The evaluation results are shown in Table 2. The combinations of the anion species and the cation species in Table 1 mean the ionic liquids shown in Table 4.

Comparative Example 1

An elastic layer forming rubber composition was obtained in the same way as in Example 1, except that no ion conducting agent was blended and 5 mass parts of triethylene glycol (TEG) was blended. A pressure roller C1 was obtained in the same procedure as in Example 1 for the subsequent steps. The evaluation results are shown in Table 2.

Comparative Example 2

A pressure roller C2 was obtained in the same procedure as in Example 1, except that bis(trifluoromethane sulfonyl) imide-lithium (Li—N111) as an ion conducting agent was blended to the silicone rubber liquid concentrate in an amount of 0.2 mol/Kg as shown in Table 1. The evaluation results are shown in Table 2.

Comparative Example 3

A pressure roller C3 was obtained in the same procedure as in Example 9, except that 10 mass parts of carbon black (trade name: DENKA BLACK GRANULES, made by Denki Kagaku Kogyo Kabushiki Kaisha) instead of an ion conducting agent was blended to the silicone rubber liquid concentrate as shown in Table 1. The evaluation results are shown in Table 2.

TABLE 1

| | | Liquid silicone rubber (mass part) | Resin micro-balloons (mass part) | Volume ratio of resin microballoons in elastic layer forming rubber composition (vol. %) | Conducting agent Cation species | Conducting agent Anion species | Conducting agent (mol/kg) | Aggregating agent Type | Aggregating agent (mass part) |
|---|---|---|---|---|---|---|---|---|---|
| Example | 1 | 100 | 2 | 40 | EMI | EF41 | 0.2 | — | — |
| | 2 | 100 | 2 | 40 | BMI | EF41 | 0.2 | — | — |
| | 3 | 100 | 2 | 40 | EtMePy | EF41 | 0.2 | — | — |
| | 4 | 100 | 2 | 40 | EMI | N111 | 0.2 | — | — |
| | 5 | 100 | 2 | 40 | EtPy | N111 | 0.2 | — | — |
| | 6 | 100 | 2 | 40 | P1.3 | N111 | 0.2 | — | — |
| | 7 | 100 | 2 | 40 | EMI | N441 | 0.2 | — | — |
| | 8 | 100 | 2 | 40 | EtPy | N441 | 0.2 | — | — |
| | 9 | 100 | 2 | 40 | EMI | EF11 | 0.2 | TEG | 5 |
| | 10 | 100 | 2 | 40 | BMI | EF11 | 0.2 | TEG | 5 |
| | 11 | 100 | 2 | 40 | EtMePy | EF11 | 0.2 | TEG | 5 |
| | 12 | 100 | 2 | 40 | EMI | PF6 | 0.2 | TEG | 5 |
| | 13 | 100 | 2 | 40 | BMI | CL | 0.2 | TEG | 5 |
| | 14 | 100 | 2 | 40 | Li | N111 | 0.2 | TEG | 5 |
| | 15 | 100 | 2 | 40 | Li | EF41 | 0.2 | TEG | 5 |
| Comparative Example | 1 | 100 | 2 | 40 | — | — | — | TEG | 5 |
| | 2 | 100 | 2 | 40 | Li | N111 | 0.2 | — | — |
| | 3 | 100 | 2 | 40 | | Carbon black | 10 | TEG | 5 |

TABLE 2

| | | Antistatic performance | Foam connecting performance | Durability |
|---|---|---|---|---|
| Example | 1 | A | A | A |
| | 2 | A | A | A |
| | 3 | A | A | A |
| | 4 | A | A | A |
| | 5 | A | A | A |
| | 6 | A | A | A |
| | 7 | A | A | A |
| | 8 | A | A | A |
| | 9 | A | A | B |
| | 10 | A | A | B |
| | 11 | A | A | B |
| | 12 | A | A | B |
| | 13 | A | A | B |
| | 14 | B | A | B |
| | 15 | B | A | B |
| Comparative Example | 1 | C | A | — |
| | 2 | B | C | — |
| | 3 | B | C | — |

TABLE 3

| Symbol | Name of substance |
|---|---|
| BMI | 1-butyl-3-methylimidazolium |
| EF41 | perfluorobutanesulfonate |
| N111 | bis(trifluoromethanesulfonyl)imide |
| EMI | 1-ethyl-3-methylimidazolium |
| N441 | bis(perfluorobutanesulfonyl)imide |
| EtPy | 1-ethylpyridinium |
| EtMePy | 1-ethyl-3-methylpyridinium |
| EF11 | trifluoromethanesulfonate |
| PF6 | hexafluorophosphate |
| P.I.3 | 1-methyl-1-propylpyrrolidinium |
| Li | lithium |
| CL | chlorine |

TABLE 4

| Combination of anion species and cation species | ionic liquid | |
|---|---|---|
| BMI-EF41 | perfluorobutanesulfonate | 1-butyl-3-methylimidazolium |
| EtMePy-EF41 | perfluorobutanesulfonate | 1-ethyl-3-methylpyridinium |
| EMI-N111 | bis(trifluoromethanesulfonyl)imide | 1-ethyl-3-methylimidazolium |
| EtPy-N111 | bis(trifluoromethanesulfonyl)imide | 1-ethylpyridinium |
| PI.3-N111 | bis(trifluoromethanesulfonyl)imide | 1-methyl-1-propylpyrrolidinium |
| EMI-N441 | bis(perfluorobutanesulfonyl)imide | 1-ethyl-3-methylimidazolium |
| EtPy-N441 | bis(perfluorobutanesulfonyl)imide | 1-ethylpyridinium |
| EMI-EF11 | trifluoromethanesulfonate | 1-ethyl-3-methylimidazolium |
| BMI-EF11 | trifluoromethanesulfonate | 1-butyl-3-methylimidazolium |
| EtMePy-EF11 | trifluoromethanesulfonate | 1-ethyl-3-methylpyridinium |
| EMI-PF6 | hexafluorophosphate | 1-ethyl-3-methylimidazolium |
| BMI-CL | chloride | 1-butyl-3-methylimidazolium |
| Li-N111 | bis(trifluoromethanesulfonyl)imide | lithium |
| Li-EF41 | perfluorobutanesulfonate | lithium |

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2013-115326, filed May 31, 2013, which is hereby incorporated by reference herein in its entirety.

What is claimed is:

1. An electrophotographic member comprising an elastic layer, wherein the elastic layer comprises:

a plurality of voids derived from resin microballoons, the voids being connected to and made open to each other; and an ionic liquid.

2. The electrophotographic member according to claim 1, wherein an anion of the ionic liquid is at least one of:

a perfluoroalkyl sulfonate ion having 4 to 10 carbon atoms, and a perfluoroalkyl sulfonimide ion having 1 to 4 carbon atoms.

3. The electrophotographic member according to claim 1, wherein the elastic layer is disposed on a substrate.

4. The electrophotographic member according to claim 1, wherein the elastic layer comprises a silicone rubber.

5. The electrophotographic member according to claim 1, wherein a release layer is disposed on the elastic layer.

6. The electrophotographic member according to claim 5, wherein the release layer comprises a fluoro rubber or a fluororesin.

7. The electrophotographic member according to claim 1, wherein the elastic layer is a cured material of an elastic layer forming rubber composition which comprises the resin microballoons, the ionic liquid, and an aggregating agent for the resin microballoons.

8. The electrophotographic member according to claim 7, wherein the elastic layer forming rubber composition further comprises an addition curing liquid silicone rubber.

9. The electrophotographic member according to claim 7, wherein the resin microballoons cause no foam breakage when heated at 100° C. and cause foam breakage when heated at 200° C.

10. The electrophotographic member according to claim 7, wherein the resin microballoons are at least one selected from the group consisting of acrylonitrile resin microballoons having a gas enclosed in a shell formed of an acrylonitrile resin, vinylidene chloride resin microballoons having a gas enclosed in a shell formed of a vinylidene chloride resin, and phenol resin microballoons having a gas enclosed in a shell formed of a phenol resin.

11. The electrophotographic member according to claim 7, wherein the aggregating agent is a polyol.

12. A heat fixing assembly comprising a heating unit and a pressure member disposed opposed to the heating unit, allowing a recording material having an unfixed toner image supported thereon to be introduced between the heating unit and the pressure member for fixing the toner image on the recording material, wherein the pressure member is the electrophotographic member according to claim 1.

* * * * *